US005765301A

United States Patent [19]

Clendenning

[11] Patent Number: 5,765,301

[45] Date of Patent: Jun. 16, 1998

[54] RETENTION APPARATUS FOR A GROUND ENGAGING TOOL

[75] Inventor: Charles Clendenning, Broken Arrow, Okla.

[73] Assignee: H&L Tooth Company, Tulsa, Okla.

[21] Appl. No.: 689,230

[22] Filed: Aug. 5, 1996

[51] Int. Cl.[6] ..... E02F 9/28

[52] U.S. Cl. ..... 37/457; 37/455; 403/355

[58] Field of Search ..... 37/455, 456, 457, 37/458; 403/150, 153, 297, 355; 299/109, 111, 113

[56] References Cited

U.S. PATENT DOCUMENTS

| | | | |
|---|---|---|---|
| 3,526,435 | 9/1970 | Krekeler | 37/457 X |
| 3,624,827 | 11/1971 | Liess | 37/456 X |
| 4,324,057 | 4/1982 | White . | |
| 4,338,736 | 7/1982 | Radigan . | |
| 4,516,340 | 5/1985 | Launder . | |
| 4,727,663 | 3/1988 | Hahn | 37/458 |
| 5,272,824 | 12/1993 | Cornelius | 37/455 X |
| 5,617,655 | 4/1997 | Launder et al. | 37/457 |

*Primary Examiner*—Michael J. Carone
*Assistant Examiner*—Robert Pezzuto
*Attorney, Agent, or Firm*—John W. Harbst

[57] ABSTRACT

A retainer pin assembly for releasably securing a ground engaging tool in position relative to an implement such as an excavator bucket, shovel and the like. The ground engaging tool is configured to fit about an apertured portion of the implement. Those portions of the tool fitting about the implement define a pair of axially aligned holes. The retainer pin assembly includes an elongated retaining pin extending through the aperture defined by the implement and the axially aligned holes in the tool for securing the tool to the implement. The retaining pin of the assembly is operably secured toward a central portion of the pin in positive locking relationship relative to the implement to inhibit axial or endwise movement of the retaining pin within the bore of the implement.

66 Claims, 7 Drawing Sheets

RETENTION APPARATUS FOR A GROUND ENGAGING TOOL

FIELD OF THE INVENTION

The present invention relates generally to ground engaging tools of the type used on excavating equipment such as shovels, buckets and the like and, more particularly, to a retaining pin assembly for releasably securing a ground engaging tool to such equipment.

BACKGROUND OF THE INVENTION

Earthworking and ground engaging tools such as excavation teeth are commonly known in the industry for use in conjunction with earthmoving implements such as excavators, shovels, and buckets. Typically, such tools are mounted in side-by-side relations across a forward edge of the equipment and are replaceable should they become broken or dull. Periodic replacement is necessary since the tools are subject to extreme loads and wear due to operation in conditions where they encounter rock, sand and other types of abrasive earthen materials.

Such ground engaging tools can take a myriad of shapes and sizes. As used herein "tools" are intended to include lip protectors, lip shrouds, and other ground engaging tools including, but not limited to, ground engaging tooth assemblies. For exemplary purposes, the present invention is illustrated and described for use with a ground engaging tooth assembly. As mentioned, however, the present invention is equally applicable to other ground engaging equipment.

As is well known, an excavation tooth assembly includes an adapter or support and an excavator tooth carried by and connected to the adapter. A rear end of each adapter is fastened to a lip of a bucket or other suitable piece of excavating equipment and extends forwardly therefrom. At their free forward end, the adapters or supports are generally configured with a nose portion. Toward their rear end, the excavation teeth are provided with a pocket area having a blind cavity for establishing a mating fit with the free end of the adapter. Traditionally, a retaining pin is thrust through axially aligned opposed holes in the excavation tooth and through a bore in the adapter to secure the tooth to the adapter. To facilitate accessibility and promote removal of the retaining pin, it is desirable to arrange the retaining pin in a generally vertical direction.

In order to expedite the replacement of a worn tooth with a new tooth, various types of retaining pins have been used to secure the replaceable teeth to the support or adapter. To minimize the time required to replace the teeth, it is desirable that the retaining pin be quickly and easily removable and reinsertable with an existing or new pin. It is also desirable that the retaining pin be reusable to conserve materials and costs. Presently known retainer pins are basically of two types. One type involves using a solid pin retention system that may be releasably maintained in place. Another retention system involves the use of a type of split pin.

Solid pin retainer systems typically include a retainer ring toward one end thereof for holding the pin in place and do nothing to forcibly urge the tool into engagement with the carrier or implement on which the tool is mounted and from which the tool extends. When tool replacement is effected, the pin is often releasably driven in the wrong direction thus exacerbating the problem of pin removal. Moreover, during operation, and as the tool begins to wear, the tool becomes looser thus the extreme forces acting on the tooth have greater wear characteristics than if the tool were snugly maintained in operative association with the implement. Tapering configurations on the adapter of a digging tooth assembly tend to urge the tooth forwardly in manner adversely effecting the performance of a solid pin retainer system.

Accordingly, split pin type fasteners have been used to force the tool rearwardly into snug engagement with the carrier thereof. That is, split pin retainer systems are advantageously configured to apply a continuous force to the tool thereby holding the tool in firm contact with the carrier or adapter. It is common practice to provide this biasing feature by intentionally offsetting or misaligning opposing holes in the tooth relative a bore in the adapter. Moreover, it is desirable to secure the retaining pin to the adapter so that the pin is not inadvertently "jacked" out of engagement with the tooth assembly due to extreme forces acting on the tooth assembly.

A split-pin arrangement typically includes two rigid, metal, elongate members are adhered to each other by a hard, resilient rubber or elastomer center. When assembled, the split pin retainer typically has an elliptical cross-sectional configuration. To restrain vertical movement of the retaining pin and prevent the retaining pin from "jacking" out of engagement with the adapter, each elongate member has shoulders toward the ends thereof for cooperative engagement with either the adapter or the excavation tooth. Presently available split pin types require an elliptical hole in the adapter or adapter, the provision of which requiring an expensive manufacturing operation. Also, split pin type retainers require a larger pair of openings in the excavating tooth than if a generally solid circular retaining were used. As will be appreciated, a pocket area of an excavating tooth through which the retaining pin passes when the tooth is attached to the adapter is highly susceptible to wear and fatigue failure. Providing a pair of holes larger than absolutely necessary in the pocket area of a excavating tooth furthermore weakens the excavating tooth thus effecting the life thereof.

Additionally, a split or two piece retaining pin requires and intensive manual effort and time to produce. The two metal parts or members forming the split pin have different configurations. Accordingly, the two metal parts or members of a split pin require separate machining or forging operations which are complicated by the shoulders formed at each end of each elongate member. Proper and precise vulcanizing or bonding of the rubber or elastomer to the metal members also involves a time consuming laborious process.

As will be appreciated by those skilled in the art, and because of the different shoulders provided at opposite ends of the pin members, presently available split pin type retainers assemble to the tooth in only a specific rotational orientation. Accordingly, inadvertent failure to properly insert and assemble the locking pin to the tooth will require further time to be spent correcting the problem created through wrong assembly procedures.

During operation, the tooth and the adapter are subjected to extreme loading conditions. Significant forces are likewise applied to the pin retainer tending to arcuately bend the pin along its longitudinal axis. The forces applied to a conventional split pin design are concentrated toward opposite ends thereof in the area where the shoulders on the pin members are disposed for cooperative engagement with the adapter and tooth to prevent the pin from "jacking" out of engagement with the excavating tooth assembly. As the pin repeatedly flexes and bends in response to the extreme loading conditions to which it is subjected, the rubber or elastomer center of the split pin tends to fret and deteriorate. As the rubber tends to deteriorate, the split pin looses its holding force thus resulting in possible loss of the tooth assembly from the bucket. Moreover, the bending of the split pin between opposite ends thereof also causes the shoulders at opposite end of the pin to lose their locking association with the adapter and the tooth thereby enhancing the ability of the split pin to be jacked out of engagement with the tooth assembly during an excavating operation thereby losing the locked association between the adapter and the tooth.

Excavating teeth are normally operated in a mining or other environment laden with dust, dirt, rocks and the like. As the pin flexes in response to the extreme loads being applied thereto, dirt and debris tend to move and become entrapped between the ends of the pin and the hole in the tooth thereby preventing the pin from returning to its locked position. Since the pin is prevented from returning to its locked position, it is easily displaced thus resulting in loss of the tooth relative to the adapter. As will be appreciated, the openings in the tooth allowing the split pin retainer to pass endwise therethrough also allow dust and dirt to pass into contact with the rubber or elastomer of the split pin retainer. Accordingly, the dust and dirt tend to further destroy the rubber used to flexibly secure the pin members to each other. Cold weather conditions moreover effect the performance of the split pin by rendering the elastomer more rigid.

Another significant problem with split pins involves their insertion and removal of the pin through the tooth and adapter. To effect either insertion or removal of the split pin, the rubber or elastomer between the two metal members needs to be compressed thereby allowing endwise movement of the pin through the tooth and adapter. To effect such compression requires a significant amount of force to be applied to the pin. During removal of the pin, the frictional drag and compressive relationship between engaging surfaces of the pin and the adapter must be overcome. As will be appreciated, the oval cross-sectional configuration of the split pin design only exacerbates surface contact and thus increases the amount or level of force required to remove the pin. Moreover, contaminants between those surfaces also tends to increase the force required to remove the pin. The level of force required to insert or remove the pin, and the shear forces between the metal members and the rubber or elastomer center, often result in failure of the bond therebetween such that the pin is generally not reusable.

U.S. Pat. No. 4,3245,0587 to K. M. White discloses an alternative pin arrangement for securing an excavator tooth to an adapter. In the White device, an elastomeric insert is fitted within a bore of the adapter for receiving a straight pin. As noted above, such a device utilizes intentional misalignment of the holes in the tooth and the bore in the adapter, such that the retainer pin, when installed, will cause the preferred tight fit on the mating surfaces of the tooth and adapter. Testing has revealed, however, a significant problem is presented when a pin, such as that shown in the White device, is attempted to be driven through a elastomeric insert. The level of compressive forces required for the elastomer, as discussed above, and the drag of the surfaces between the pin and the insert, and the lack of a positive mechanical lock for retaining the pin against axial displacement during operation, have eliminated this design from consideration.

Thus, there is a need and a desire for a retainer pin assembly that facilitates installation and removal of the pin relative the assembly thereby allowing the tool to be readily secured to or removed from the equipment, which is not susceptible to extreme loading conditions applied thereto, and which does not rely upon its relative fit to the tool in order to prevent jacking and inadvertent release of the tool from the equipment.

SUMMARY OF THE INVENTION

In view of the above, and in accordance with the present invention, there is provided a retainer pin assembly for releasably securing a ground engaging tool in position relative to an implement such as an excavator bucket, shovel and the like. The ground engaging tool is configured to fit about an aperture portion of the implement. Moreover, those portions of the tool that fit about the implement define a pair of axially aligned holes. The retainer pin assembly includes an elongated retaining pin extending through the aperture defined by the implement and the axially aligned holes in the tool for securing the tool to the implement. A salient feature of the present invention involves operably securing a central portion of the pin in positive locking relationship relative to the implement to inhibit axial or endwise movement of the retaining pin within the bore of the implement.

In a preferred form of the invention, the retainer pin assembly is of two-piece design including the retaining pin and an insert retained within the bore of the implement by cooperative engagement with the ground engaging tool. The insert includes an exterior resilient covering attached to an elongated rigid metal sleeve. In assembled condition, the retaining pin extends through the sleeve and through the opposed holes in the tool and the resilient member tends to urge the tool into engagement with the implement. The rigid metal sleeve adds support and strength along the pin to advantageously effect distribution of forces acting on the retaining pin along the entire length of the pin rather than at opposite ends thereof as with the prior art.

In accordance with one aspect of the present invention, there is provided an excavator tooth assembly including a support or adapter and an excavation tooth. The adapter defines a bore extending therethrough and includes a base portion and a forwardly extending nose portion. The excavation tooth has a cutting end and a mounting end. The mounting end of the tooth defines a pocket for receiving and releasably accommodating a lengthwise portion of the nose region of the adapter. The mounting end of the excavator tooth has two opposed and axially aligned holes that act in conjunction with the bore extending through the adapter. According to the present invention, a retaining pin extends through the bore and the opposed holes for securing the excavation tooth to the adapter. To restrain axial movement of the retaining pin within the bore, a central portion of the retaining pin is secured in interlocking relationship to the adapter thereby extreme forces applied to the excavator tooth assembly have little or no effect on the locking relationship of the pin relative to the adapter. Moreover, positioning the central portion of the retaining pin within the bore inhibits debris from interfering with the interlocking relationship between the retaining pin and the adapter or support.

Another aspect of the present invention is to provide an insert which is held within the bore of the adapter by cooperative engagement with the excavation tooth. The insert includes a resilient member attached to an exterior surface of a rigid sleeve. The retaining pin extends endwise through the sleeve and the opposed holes in the tooth for biasing the excavation tooth rearwardly along the adapter thus maintaining a snug fit between the adapter and the tooth.

In a preferred form of the invention, the retaining pin and the insert into which it fits have substantially corresponding cross-sectional configurations. Accordingly, the present invention offers significantly less surface contact relative the interior of the sleeve than does a correspondingly sized prior art split pin design. The retention pin of the present invention is therefore easier to insert and disassemble than prior art designs. Moreover, because the pin of the present invention fits within a sleeve, the compressive and friction drag between adjacent surfaces of the pin and sleeve are considerably less than prior art designs without effecting the holding ability of the pin relative to the adapter or tooth. This advantage becomes increasingly more apparent with larger applications.

In a preferred form of the invention, the resilient member is attached to an exterior forward section of the sleeve and the locking member is embedded in the resilient member and extends through an aperture in the sleeve. The locking member extends radially inwardly for interlocking engagement with the retaining pin. Preferably, the retaining pin has a circumferential channel formed in a center section thereof for locking engagement with the locking member.

As will be appreciated by those skilled in the art, the pin or locking member can be specifically configured to control the level of force required and the direction to remove the retaining pin from the sleeve. The level of force required to remove the pin can be controlled as a function of the interrelationship between the locking member and the retaining pin. In a preferred form of the invention, a chamfer is provided on either the radial pin or the locking member allowing a ramping function to be achieved when to pin is moved in an axial direction. The angle of the chamfer controls the level of force required to overcome the locking relationship of the locking member and the pin. Alternatively, arranging the chamfer or ramp surface on only one surface of the channel defined by the locking pin or the locking member will control the axial direction in which the pin must be moved to effect release of the tooth from the adapter.

An alternative form of the present invention is also provided for a tooth assembly used in lighter duty applications where the forces acting on the retaining pin are not as sever or have the magnitude where a greater holding force is required of the retention pin. In this alternative form of the invention, the insert includes a resilient member attached to an exterior surface of a rigid sleeve defining a longitudinal bore and wherein the sleeve has a longitudinal slot extending the length thereof thereby allowing expansion and contraction of the sleeve within the bore on the adapter. The sleeve is held within the bore of the adapter by cooperative engagement with the excavating tooth fitted to the adapter. Approximately mid-length thereof, the sleeve is provided with an indentation extending radially inwardly into the bore defined by the sleeve. As mentioned above, the sleeve acts to distribute the forces applies to the retention pin assembly along the entire length of the retaining pin. As mentioned above, the retaining pin has a circumferential channel formed approximately mid-length thereof. The channel is adapted to accommodate the detent on the sleeve when the channel longitudinally aligns therewith thus maintaining the pin in a locking relationship approximately midlength thereof thereby maintaining the pin in a locked relationship notwithstanding the effect bending forces have on the pin.

As is conventional, the adapter is typically provided with upper and lower slanting surfaces that converge relative to each other and toward the free end of the adapter. In this regard, the insert of the pin retention assembly is specifically configured to provide a visual indication of the manner in which the sleeve of the pin assembly is to be assembled into the bore of the adapter. That is, the sleeve of the retention pin assembly is provided with slanted surfaces at opposite ends thereof. The slanted surfaces on the sleeve generally parallel the slanted surfaces typically provided on the upper and lower surfaces of the adapter. Accordingly, when the sleeve is inserted into the bore in the adapter, the slanted surfaces at opposite ends of the sleeve provide a quick and ready reference whether the sleeve is inserted properly into the adapter. If the sleeve is incorrectly positioned within the bore of the adapter, the opposite ends of the sleeve will project beyond the adapter thus indicating the insert is not properly positioned thereby minimizing the time required to reinstall the insert.

In an alternative form of the invention, the insert of the retaining pin assembly includes a pair of rigid elongated sleeves each having a resilient spring like member extending about a circumferential portion of the sleeve. The sleeves are substantially identical in length and each has a longitudinal slot extending the length thereof thereby allowing expansion and contraction of the sleeve within the bore on the adapter Each sleeve is held within the bore of the adapter by cooperative engagement with the excavating tooth fitted over the adapter. The bores defined by the sleeves are arranged in axial alignment relative to each other. The cumulative length of the sleeves in this alternative form of the invention is less than the distance separating upper and lower surfaces of the adapter at that location wherein the sleeves are inserted within the bore of the adapter. In this form of the invention, one sleeve is inserted from one side of the adapter while the other sleeve is inserted from an opposite side of the adapter thereby providing a generally centralized gap or opening between confronting surfaces of the sleeves. In this form of the invention, the retaining pin is provided with an outside surface configuration generally corresponding to the interior surface configuration of the axially aligned sleeves. The retaining pin furthermore defines a detent extending radially outwardly and is generally centrally disposed along the length of the retaining pin. When the sleeve is inserted into the openings defined by the axially aligned sleeves, the outside of the pin passes therealong until the detent engages one of the sleeves. Further axial movement of the retaining pin will cause the sleeve to expand against the action of the resilient member thereby allowing the detent to move axially along the length of the sleeve until it reaches the gap established between the sleeves. Thereafter, the sleeve automatically contracts thus capturing the detent between the two sleeves. Because the locking detent is disposed about midlength of the pin, the bending forces of the pin will have substantially no effect on the ability of the sleeves to maintain the pin in a locked relationship thereby preventing endwise displacement.

In still another embodiment of the present invention, a seal is provided at opposite ends of the insert. The seal extends across the bore defined by the sleeve and into which the retainer pin is to be fitted. The retaining pin passes endwise through the seal when assembled to the insert. The purpose of the seal is to prevent contaminants such as dirt, dust, and debris from passing between the retainer pin and the sleeve of the insert thereby facilitating removal of the retainer pin during replacement or repair of the tooth.

The present invention provides significant advantages over other pin arrangements for releasably securing a ground engaging tool to an implement. The centrally disposed locking engagement between the retaining pin and the implement or apparatus maintains the pin within the implement or apparatus even though the pin may bend as a result of the extreme digging forces applied to the tool during operation of the excavating equipment. As will be appreciated, the ability of the present invention to positively secure the pin against endwise movement approximately midlength significant reduces and substantially eliminates the effect bending forces have on the pin since the pin is positively locked in place at a location where the bending forces acting on the pin are at their least. Furthermore, positioning the lock for the pin at about midlength of the pin inhibits dirt, dust and debris from interfering with operation of the locking mechanism. The provision of an elastomer in combination with the sleeve provide a dual benefit. First, the elastomer maintains the tool in snug engagement with the carrier thereof. Also, the elastomer augments the positive locking engagement of the lock with the adapter when the pin bends in response to extreme loading conditions being applied to the tool.

In a most preferred form of the invention, the retaining pin and sleeve each have a circular cross-sectional configuration along their length. Using a cylindrical pin design allows the pin assembly of the present invention to remain simple and be economically produced on conventional screw machines or the like. The cylindrical design of the pin assembly of the present invention minimizes the size of the openings in the pocket portion of the tool thereby adding strength to the overall tool design. Additionally, using a cylindrical design for the retaining pin minimizes the size of the openings in the tool and thereby lessens the amount of dirt, dust and debris that can pass inwardly toward the pin. An important aim of the present invention was to utilize a round retaining pin thereby reducing surface contact of the pin thereby yielding advantageous removal of the pin without sacrificing strength or rigidity of the or holding ability of the retainer pin assembly. It should be appreciated, however, that an oval or an elliptical cross-sectional configuration for the pin and sleeve would equally apply.

Another object of the present invention was to design a retaining pin assembly such that the rubber or elastomer fitted about the pin assembly is protected to the fullest extent by the tool after the tool is assembled onto the receiving implement. Still another advantageous feature of the present invention involves the ability to provide a pin retainer wherein the pin is always inserted correctly into the receiving bore on the receiving implement. Moreover, the combination of the resilient member and the rigid sleeve provide a self-aligning insert that facilitates assembly and disassembly of the retaining pin and securely biases the tool onto the receiving implement.

The present invention, together with further objects and advantages, will be best understood by reference to the following detailed description taken in conjunction with the accompanying drawings.

DETAILED DESCRIPTION OF THE PREFERRED EMBODIMENT

Figure 1:
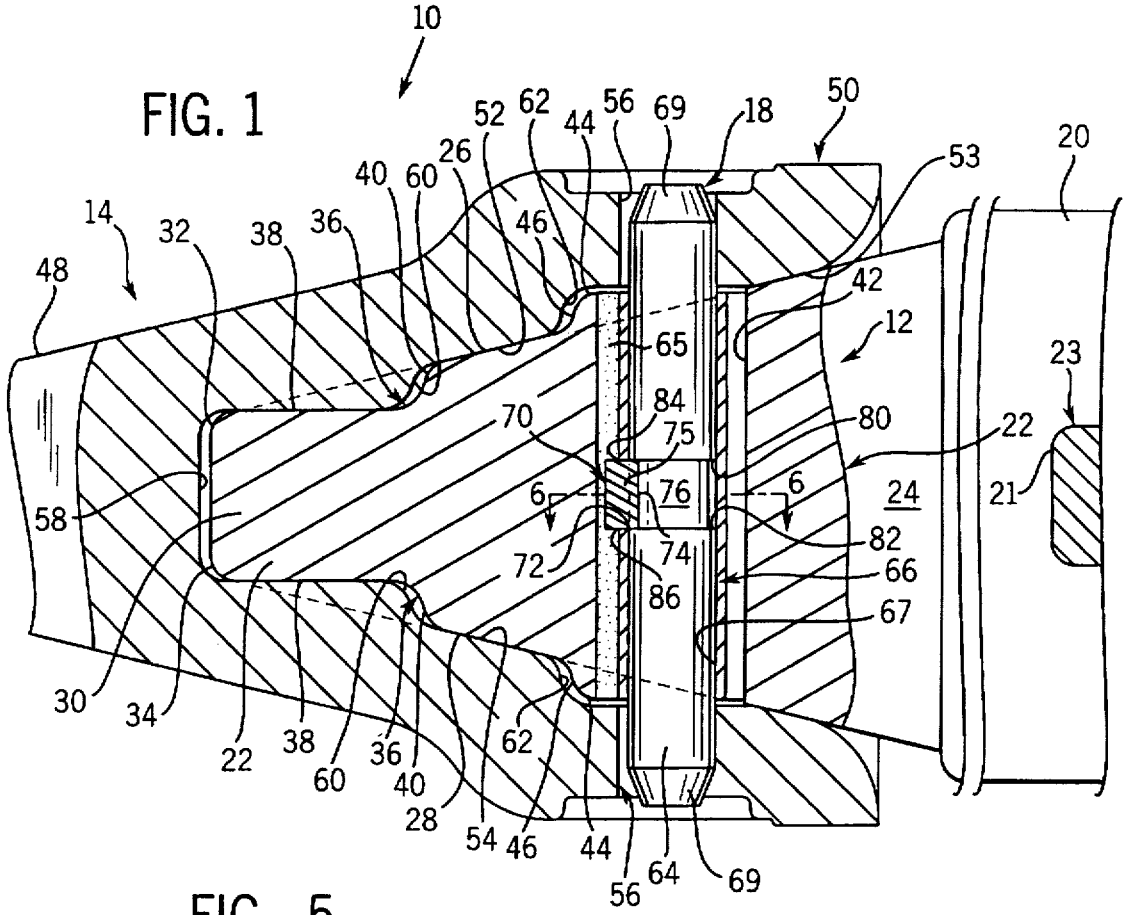
FIG. 1 is a longitudinal sectional view of one form of the present invention used to hold a tool in place relative to a carrier or adapter.

While the present invention is susceptible of embodiments in various forms, there is shown in the drawings and will hereinafter be described preferred embodiments of the invention with the understanding that the present disclosure is to be considered as setting forth exemplifications of the invention which are not intended to limit the invention to the specific embodiments illustrated.

Referring now to the drawings, wherein like reference numerals refer to like parts throughout the several views, there is shown in FIG. 1 a ground engaging tool 10 that is releasably attached to excavating equipment. As mentioned above, the ground engaging tool 10 can take a myriad of shapes and sizes. Such tool can take the form of lip protector, a shroud, or, as shown for exemplary purposes, an excavating tooth assembly. Although shown in combination with an excavating tooth assembly 10, it should be appreciated that the teachings and principals of the present invention are equally applicable to other ground engaging tools other than shown without detracting or departing from the spirit and scope of the present invention.

As shown, the tooth assembly 10 includes a support or adapter 12, an excavating tooth 14, and a retainer pin assembly generally represented by reference numeral 18 and embodying principals of the present invention. Although only a single tooth assembly 10 is shown in FIG. 1, it will be understood by those skilled in the art that for typical excavating equipment such as a bucket and the like, a plurality of spaced apart tooth assemblies substantially identical to the tooth assembly 10 would extend from the bucket. Additionally, the terms horizontal and vertical as used herein refer generally to the orientation of the excavating implement upon the ground, wherein the excavation movement of the implement would be primarily in the vertical direction, although horizontal loads are also imparted on the tooth assembly 10.

As illustrated in FIG. 1, the support or adapter 12 is of conventional design and includes a base portion 20 adapted to be secured by welding or by a suitable releasable locking mechanism to an edge 21 of an excavating shovel, or bucket 23. A nose portion 22 of the support or adapter 12 projects forwardly from the base portion 20 for mating with and carrying the tooth 14. In the illustrated form, the nose portion 22 of adapter 12 has a pair of lateral side walls 24 and opposed upper and lower surfaces 26 and 28. In the illustrated form, the upper and lower surfaces 26, 28, respectively, taper and converge toward a free end of the nose portion 22 of support 12. As shown, the nose portion 22 preferably terminates in a outwardly bowed, curved terminal end portion 30 and is provided with an upper radius 32 and a lower radius 34 at the juncture of the upper and lower surfaces 26 and 28, respectively. This end configuration of the adapter assists in stabilizing the tooth 14 and provides a self-centering feature when the tooth 14 is under horizontal side loads.

In the illustrated form, the opposed surfaces 26 and 28 on adapter 12 also have a recessed areas 36 cut therein at the extended ends thereof which define flat substantially horizontal stabilizing surfaces or forward lands 38 bordered by curvilinear vertical stabilizing walls 40. As will be appreciated by those skilled in the art, the horizontal forward lands 38 provide greater load distribution to absorb extreme vertical loads, and the vertical stabilizing walls 40 provide additional vertical bearing surfaces to assist in absorbing extreme horizontal loads.

The support or adapter 12 has a bore 42 extending through the rearward portion of the nose portion 22. In the illustrated form of the invention, the bore 42 is shown extending generally vertically between and opening to the upper and lower surfaces 26 and 28, respectively, of the adapter 12. It should be appreciated, however, that the bore 42 does not necessarily have to extend vertically. Instead, the bore 42 may extend horizontally and open to the opposing side walls 24 of the adapter 12. Alternatively, the bore 42 can extend at any particular orientation without detracting or departing from the spirit and scope of the present invention.

As shown in FIGS. 1 through 4, a pair of flat substantially horizontal stabilizing surfaces or rearward lands 44 extend outwardly from the upper and lower surfaces 26, 28 of the adapter 12 adjacent the ends of the bore 42. As with the forward lands 38, the rearward lands 44 define curvilinear vertical stabilizing walls 46 which provide additional vertical bearing surfaces to assist in absorbing extreme horizontal loads. In particular, side load distribution is transferred from horizontal to vertical into the areas of the adapter 12 surrounding the bore 42. The rearward lands 44 also provide greater vertical load distribution to absorb extreme vertical loads. Thus, the combination of the forward and rearward lands 38 and 44 substantially increases the stability of the tooth assembly 10 over a vast range of forces acting thereon. Moreover, the additional steel material provided by the rearward lands 44 strengthens the area of the adapter surrounding the bore 42, which is typically the weakest area of the adapter 12.

It will be appreciated that although the terminal end portion 30 and the vertical stabilizing walls 40, 46 of the adapter 12 are preferably curvilinear, they could define other shapes capable of absorbing horizontal loads acting on the adapter 12. For example, the terminal end portion 30 and vertical stabilizing walls 40, 42 could each be configured with a V-shape since both sides of the "V" are eschewed or divergent from the centerline of the adapter 12.

The excavation tooth 14 has a cutting end portion 48 for excavating materials and a mounting end 50. In the illustrated form, the mounting end 50 of the tooth 14 has slightly tapered exterior side walls 51 and a cavity or pocket 52 disposed therebetween for endwise accommodating a free end of the adapter 12. Pocket 52 is defined by a opposed interior upper and lower interior surfaces 53 and 54, respectively, that complement the upper and lower surfaces 26 and 28, respectively, of adapter 12. Pocket 52 is further defined by opposed interior side walls 55 that complement the side walls 24 on the adapter 12. A pair of axially aligned holes or apertures 56 are also defined at the mounting end 50 of the tooth 14. In the illustrated form, the holes 56 extend vertically through the upper and lower surfaces 53, 54 to act in conjunction with the bore 42 in the adapter 12. As will be appreciated, however, if the hole or aperture 42 in the adapter 12 were oriented differently from that shown, the holes 56 in the pocket area of the tooth 14 would likewise be oriented differently to act in conjunction with the bore 42.

The shape of the cavity 54 generally corresponds in configuration to that portion of the of the nose portion 22 of the adapter 12 extends rearwardly from the free end thereof so that the tooth 14 can fit thereon in mating relationship. As illustrated, a concavely bowed forward section 58 of cavity 54 matingly receives the outwardly bowed end portion 30 of the adapter 12. Likewise, generally semicircular protuberances 60 extend inwardly into the cavity or pocket 54 for mating engagement with the forward lands 38, and semicircular recesses 62 are formed in the upper and lower surfaces 53, 54 of the cavity 52 adjacent each hole 56 for mating engagement with the rearward lands 44. If other configurations of the terminal end portion 30 and the stabilizing walls 40, 46 of the adapter 12 were employed, the associated surfaces of the tooth 14 would be correspondingly shaped to mate therewith.

Figure 5:
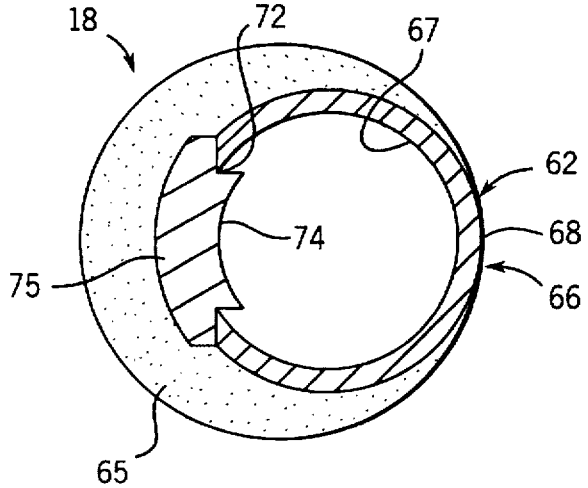
FIG. 5 is a sectional view taken along 5—5 of FIG. 2.

As shown in FIG. 1, the retainer pin assembly 18 of the present invention includes an insert 62 and a retaining pin 64. In the illustrated form of the invention shown in FIG. 4, the insert 62 includes a resilient member 65 attached to an exterior forward section of a rigid sleeve 66 defining a smooth elongated bore 67 of constant diameter opening to opposite ends of sleeve 66. The resilient member 65 can be made of rubber or other suitable resilient yet wear-resistant elastomeric material. Sleeve 66 is formed from a suitable rigid material such as alloy steel that is preferably heat treated to offer additional strength, rigidity and stiffness to the retaining pin 64 when the retaining pin 64 is endwise inserted within the bore 67 of the sleeve 66. Preferably, and as shown in FIG. 5, the resilient member 65 surrounds about a 270° circumferential portion of the sleeve 66 to leave a rearward portion 68 of the sleeve 66 free from the resilient material. Alternatively, the resilient elastomeric member 64 can extend 360° about the exterior surface of the sleeve 66 to facilitate placement of the bore 67 in sleeve 66 thereby accommodating alternate pin locations. The resilient member 65 provides compression relief for the insert 62 when it is installed in the bore 42 and when the retaining pin 64 endwise extends therethrough.

The retainer pin 64 is formed from a suitable alloy steel preferably heat treated to add strength and rigidity thereto. As shown in FIG. 1, the retainer pin 64 has an elongated configuration with a smooth and substantially constant outside diameter sized slightly less than the inside diameter of bore 67 defined by sleeve 66. In a preferred form, each end of the retaining pin 64 is provided with a chamfer 69 or other suitable configuration for facilitating endwise insertion of the retaining pin 64 into the bore 67 defined by sleeve 66 of insert 62.

Returning to FIG. 2, prior to assembly of the tooth 14 onto the support or adapter 12, the insert 62 of the retainer pin assembly 18 is installed in the bore 42 of the adapter 12. The outside diameter of the insert 62, including the sleeve 66 and resilient member 65, is preferably slightly larger than the diameter of the bore 42 in the support or adapter 12 so that the insert 62 is a light drive-in fit into the bore 42. In addition, the insert 62 is further held within the bore 42 once the tooth 14 is assembled thereto by cooperative engagement with the interior surfaces on the tooth 14 in the area of the pocket 54.

Figure 6:
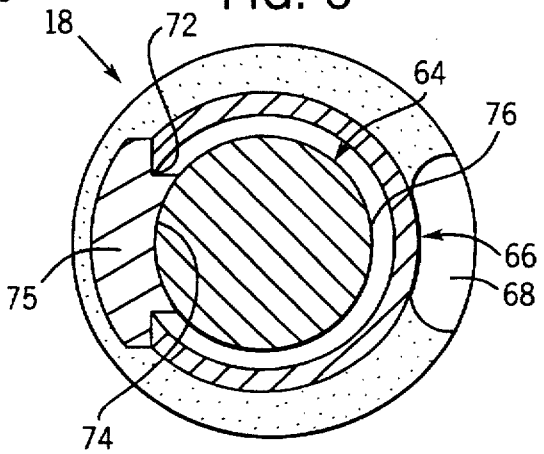
FIG. 6 is a sectional view taken along line 6—6 of FIG. 1.
Figure 2:
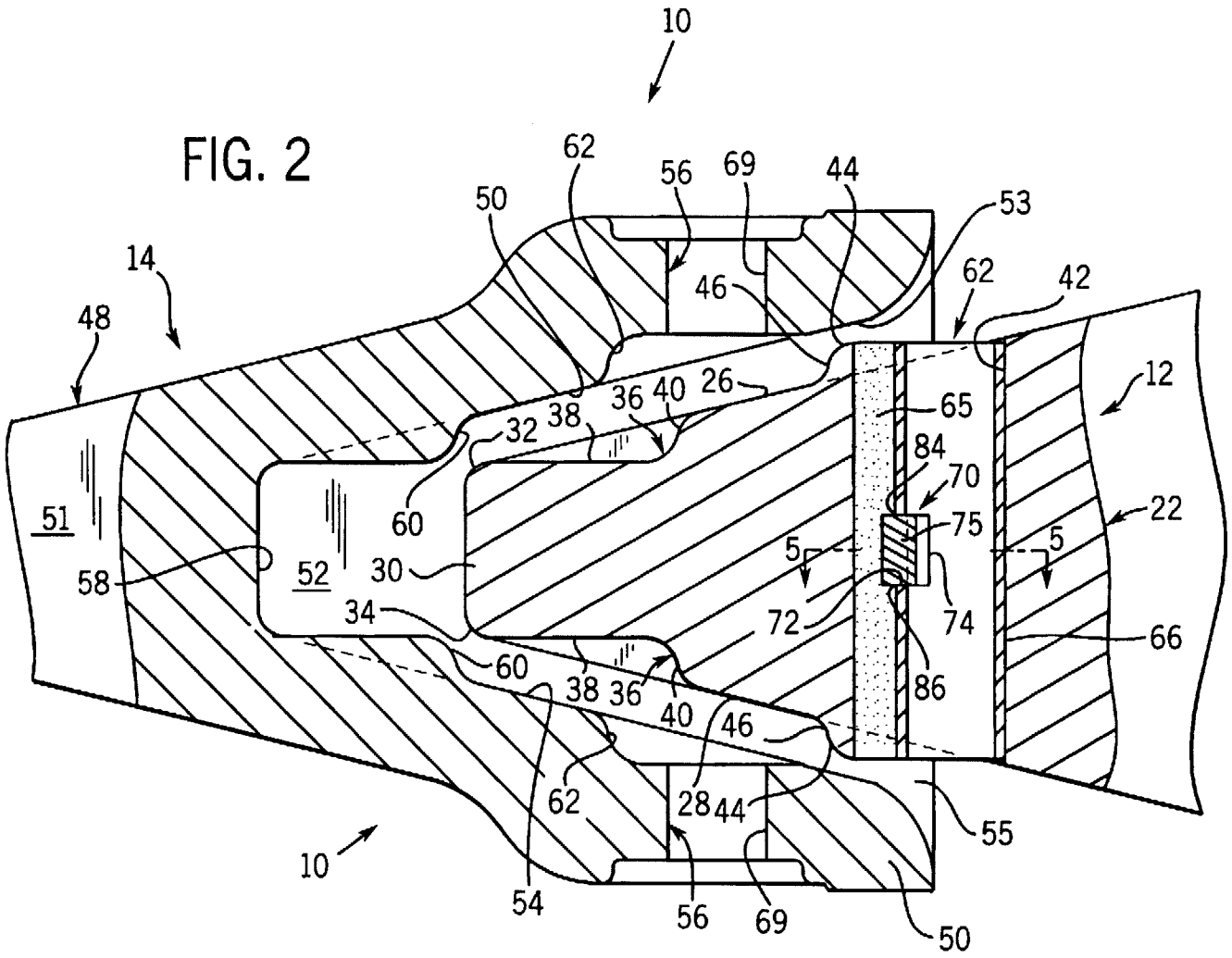
FIG. 2 is a longitudinal sectional view similar to FIG. 1 but showing the tool in disassembled relation relative to the carrier.
Figure 3:
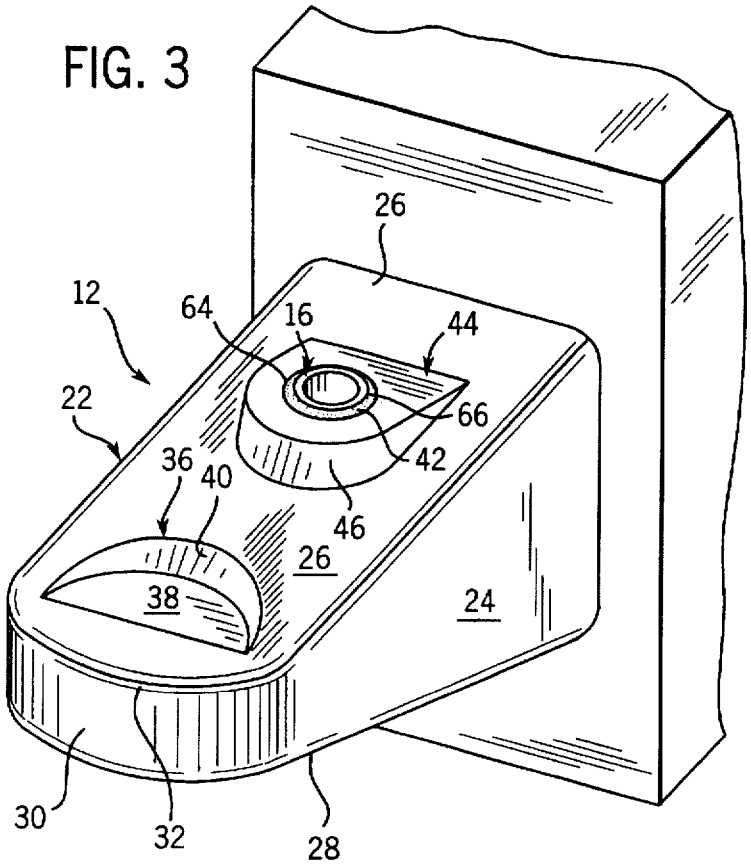
FIG. 3 is a perspective view of the carrier or adapter shown in FIGS. 1 and 2.
Figure 4:
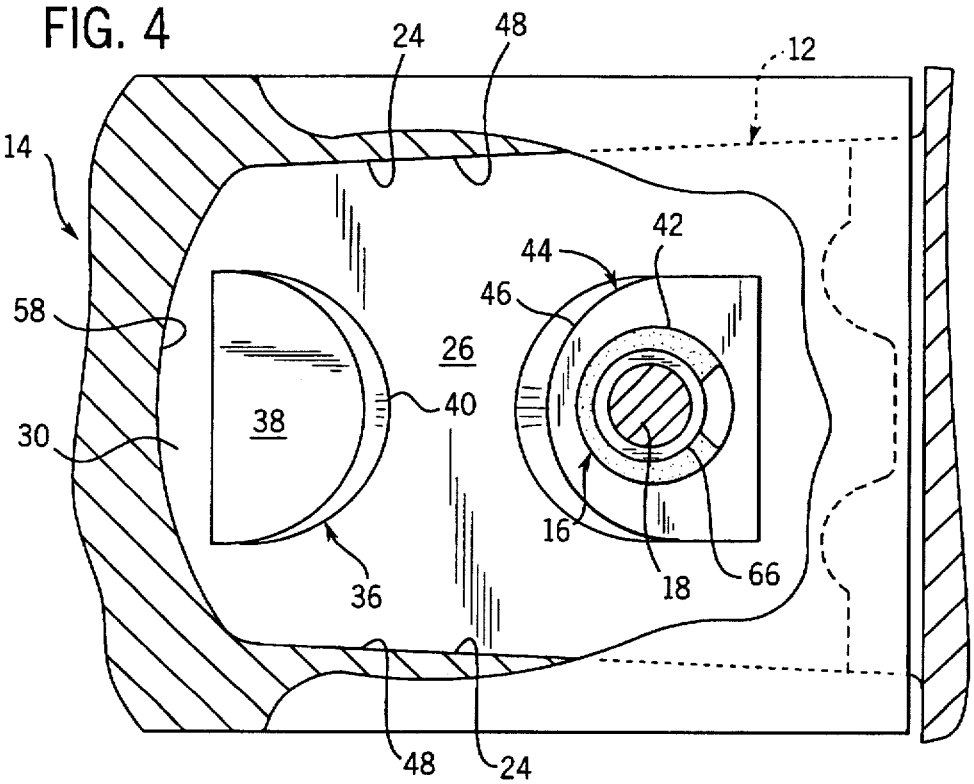
FIG. 4 is a top plan view of an excavating tool, shown broken away, mounted to the carrier or adapter.

To assemble the tooth 14 to the adapter 12 it is only necessary to place and slide the tooth over the free end of the adapter 12 such that the opposed holes 56 in the tooth 14 are generally in alignment with the bore 42 defined by the adapter 12. The retaining pin 18 is then driven into the sleeve 66 (FIGS. 1, 4 and 6) to bias the tooth 14 rearwardly along the adapter 12, thereby maintaining a tight fit between the tooth 14 and adapter 12. Preferably, the holes 56 in the tooth 14 are intentionally offset or misaligned with the bore 42 in the adapter 12 to provide the desired biasing effect. Also, the resilient member 65 serves to bias the pin 64 in the desired rearward direction. As shown in FIG. 1, the effect of these biasing features is to resiliently urge the tooth 14 onto the adapter 12.

To inhibit inadvertent "jacking" or axial movement of the retaining pin 64 out of the sleeve 66 during heavy operating conditions, and also to localize the rearward biasing effect of the resilient member 64 against the pin 18, a locking member 70 is arranged in operable combination with the resilient member 65 of insert 62 and extends radially inwardly through an aperture 72 in the sleeve 66 to establish a positive locking relationship between the retaining pin 64 and the adapter 12. In the preferred form of the invention, the locking member 70 is embedded within the resilient member 65. The locking member 70 is preferably configured with an enlarged head portion 75 for limiting the radially inward movement of the locking member 70 toward the longitudinal axis of the sleeve 66. An inner surface 74 of the locking member 70 has a radius of curvature similar to the radius of a recess or channel 76 formed in the retaining pin 18. As shown in FIG. 1, the locking member 70 is configured to "snap" under the influence of the resilient member 65 snugly into locking engagement with the channel 76 when the pin 18 is driven into the sleeve 66.

Preferably, the locking member 70 is generally centrally positioned along the length of the insert 62 and the channel or recess 76 is provided at about a longitudinal center section of the pin 64. The locking member 70 is preferably made of alloy steel that is properly heat treated or similar high strength material.

Figure 7:
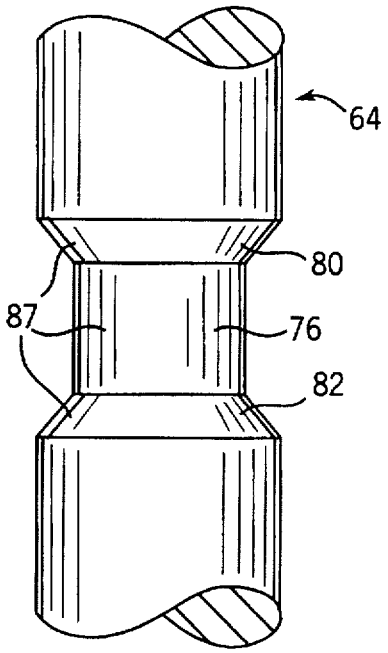
FIG. 7 is an enlarged elevational view of a central lengthwise section of one form of a retaining pin.

Preferably, the retaining pin 64 of assembly 18 is symmetrical in configuration to allow the pin 64 to be inserted within the insert 62 from either end. The pin 64 and/or the locking member 70 can be configured to control the level of force required to remove the pin from its locked position relative to the insert 62. As shown in FIG. 7, the channel 76 defined along the length of the retaining pin 64 has a diameter less than the outside diameter of pin and, thus, annular shoulders 80 and 82 are defined at the limits of the channel 76.

Figure 8:
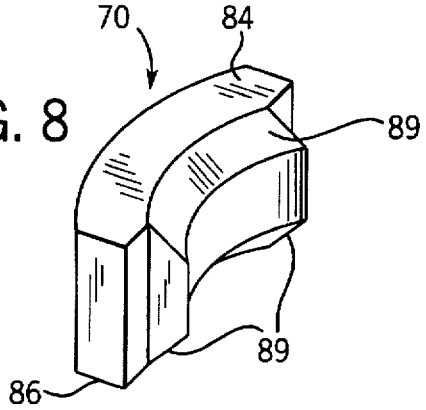
FIG. 8 is a perspective view one form of locking member for use with the present invention.

Returning to FIGS. 1 and 2, the locking member 70 defines opposing and generally parallel surfaces 84 and 86 that are separated by a distance less than the axial distance separating the shoulders 80 and 82 on the recess or channel 76 thereby allowing the locking member 70 to move radially into positive locking engagement with the pin 64. In the embodiment illustrated in FIG. 7, the annular shoulders 80 and 82 are provided with angling surfaces or ramps 87 to specifically facilitate sliding movement of the edges 84, 86 of the locking member 70 therepast. As shown, the ramps 87 are generally equal to promote movement of the retaining pin 64 in either axial direction. Alternatively, and as shown in FIG. 8, the opposed edges or surfaces 84 and 86 of the locking member 70 could be provided with similarly shaped chamfers or ramped surfaces 89 to promote movement of the locking pin 64 therepast in either direction of axial movement.

Figure 9:
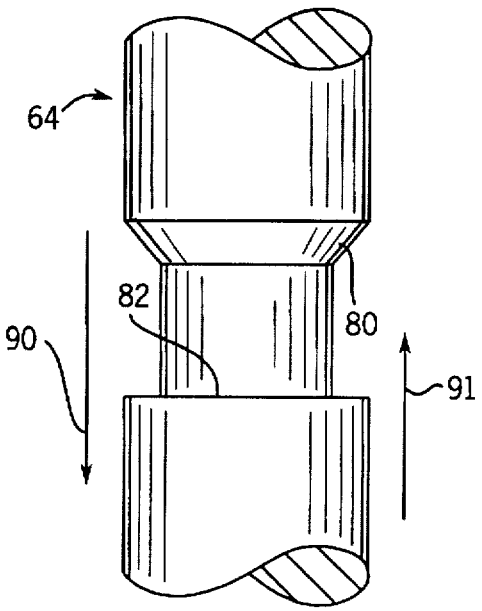
FIG. 9 is an enlarged elevational view similar to FIG. 7 but showing an alternative form of the retainer pin.

An alternative embodiment of the retaining pin 64 is schematically illustrated in FIG. 9. In this embodiment, only shoulder 80 has a chamfered or ramped surface configuration 87. The other radial shoulder 82 is disposed in substantially normal relation relative to the outside surface of the pin 64. Accordingly, the ramped surface 87 provided on shoulder 80 permits axial movement of the retaining pin 64 past locking member 70 in the direction of arrow 90 under a predetermined level of force. As will be appreciated, the opposite shoulder 82 because of its disposition relative surface 86 of the locking member 70 will require a significantly greater level or magnitude of force to be applied to free the retaining pin 64 from its locked relationship as compared to the force required to move locking member 70 in the direction of arrow 90.

Figure 10:
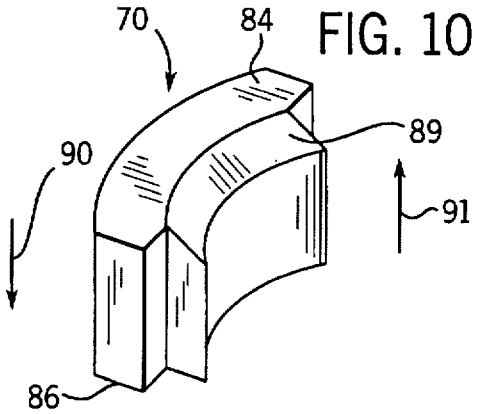
FIG. 10 is a perspective view similar to FIG. 8 but showing an alternative form of locking member.

Still another alterative embodiment of the present invention is partially illustrated in FIG. 10. In this embodiment, only surface 84 is provided with a chamfered or ramped surface configuration 89. The other surface 86 of the locking member 70 is disposed in substantially normal relation relative to the to the inner surface 74 of the locking member 70. As will be appreciated, the ramped or chamfered surface 89 will permit axial movement of the retaining pin 64 past the locking member 70 in the direction of arrow 90 under a predetermined level or magnitude of force. Moreover, the opposite surface 86, and because of its disposition relative to surface 74 of the locking member 70, will remain secured and require a significantly greater level or magnitude of force to be applied to free the retaining pin 64 from its locked relationship relative to the locking member 70 if moved in direction of arrow 91 as compared to movement of the retaining pin 64 in the direction of arrow 90.

Figure 11:
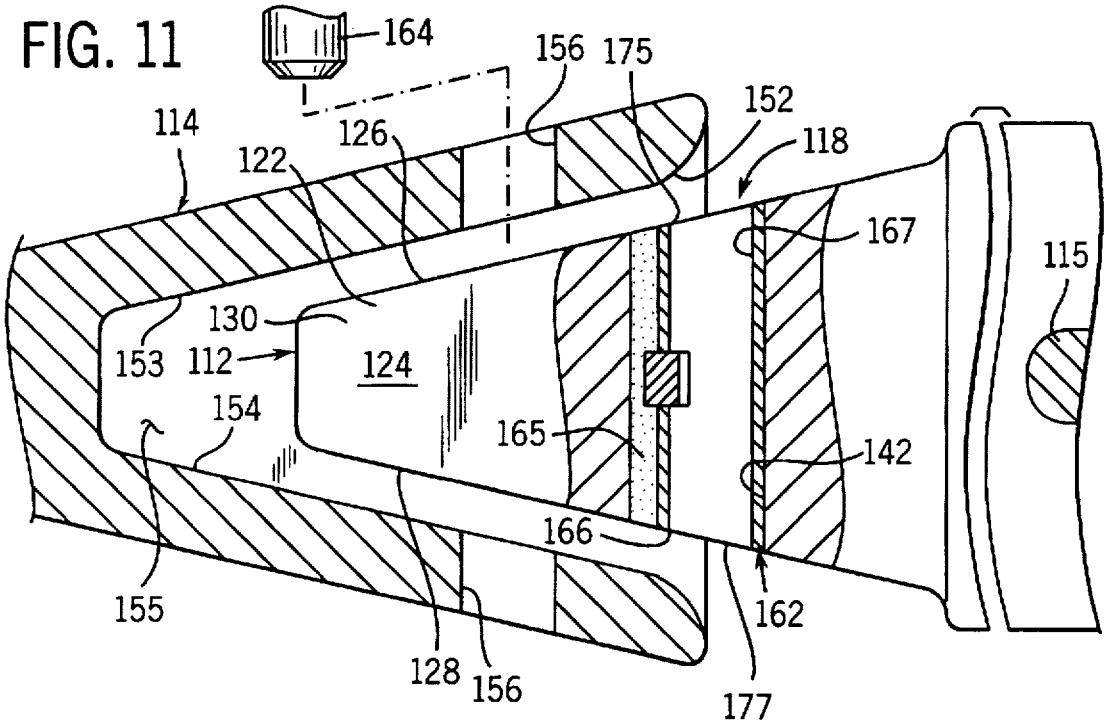
FIG. 11 is a view similar to FIG. 2 showing an alternative form of the present invention.
Figure 12:
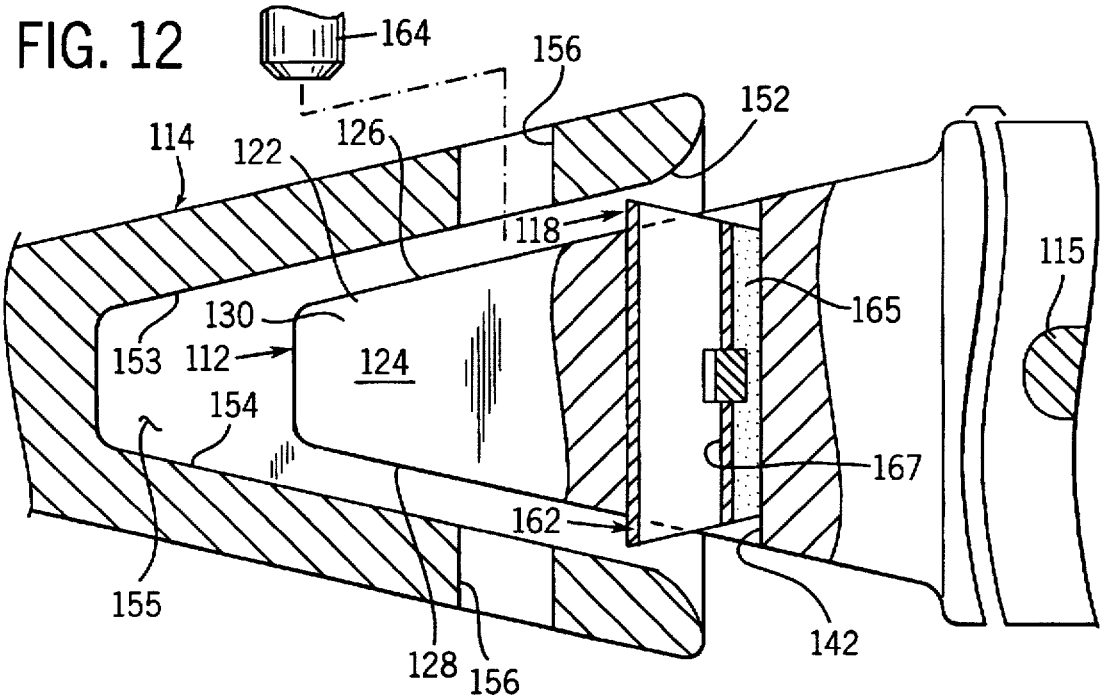
FIG. 12 is a view similar to FIG. 11 but showing wrongful insertion of a portion of the pin assembly of the present invention in the carrier or adapter.
Figure 13:
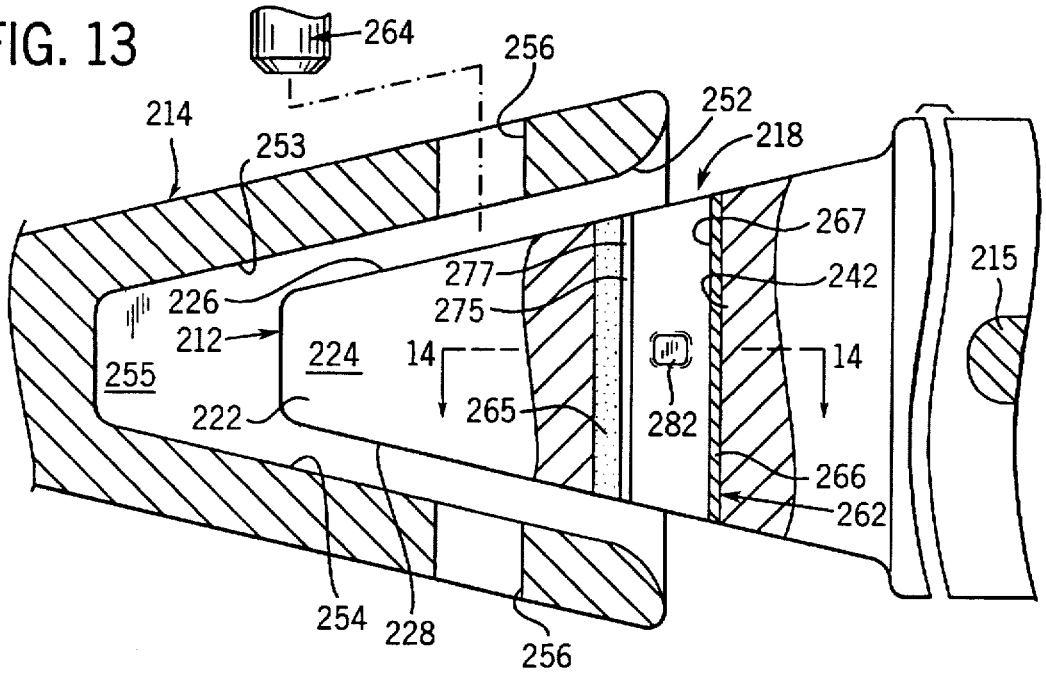
FIG. 13 is a view similar to FIG. 2 showing an alternative form of the present invention.

Another embodiment of a retainer pin assembly according to the present invention is illustrated in FIGS. 11 and 12 and is designated therein by reference numeral 118. The retainer pin assembly 118 and the excavating tool assembly which it is arranged in combination with are similar, and function in a similar manner to that described above with reference to FIGS. 1 through 6. The elements of this alterative embodiment of the retainer pin assembly and the tool assembly that are identical or functionally analogous to those of the embodiment described above are designated by reference numerals identical to those used for the earlier described embodiment with the exception that this alternative embodiment reference numerals are in the 100 series.

As shown, the retaining pin assembly 118 is used to releasably secure a tooth or other suitable ground engaging tool 114 to an adapter or support 112. The adapter 112 is suitably secured to and extends forwardly from a lip 115 of an excavating bucket or the like. A nose portion 122 of the adapter 112 has a pair of laterally spaced side walls 124 extending between tapered upper and lower surfaces 126 and 128, respectively, that converge toward a free end 130 of the adapter 112. The support 112 has a bore 142 extending therethrough. Although the bore 142 is shown in a vertical disposition, and as mentioned above, the bore 142 can be disposed at any suitable orientation without detracting or departing from the spirit and scope of the present invention.

As is conventional, a rear end of the tool 114 is provided with a suitably shaped blind cavity or pocket 152 that is shaped in a fashion complementary to the forward end of the adapter or support 112. That is, the pocket 152 is shaped with slanting upper and lower interior surfaces 153 and 154, respectively, that extend generally parallel to the upper and lower surfaces 16 and 128, respectively, of the adapter 112. Moreover, the pocket 152 includes opposed interior sidewalls 155 that are configured to complement the sidewalls 124 of the pocket 152. Suffice it to say, pocket 152 is shaped to fit along and snugly about a lengthwise portion of the support 112. A pair of axially aligned holes or apertures 156 intersect with the pocket 152.

The retainer pin assembly 118 is substantially similar to and operates in a substantially similar fashion to the pin assembly 18 discussed in detail above. The retainer pin assembly 118 includes an insert 162 and a retainer pin 164. As shown, the insert 162 includes a resilient member 165 attached to an exterior forward section of a rigid sleeve 166 defining an elongated bore 167 opening to opposite ends of the sleeve 166 It will be appreciated and understood that the insert 162 and the parts comprising same are substantially similar and functionally analogous to that described above with reference to insert 62 and, thus, no further detailed description need be provided thereto.

To facilitate proper placement of the insert 162 within the bore 142 of the adapter or support 112, the insert 162 is specifically configured to provide a quick and ready visual indication of proper placement of the insert 162 within the bore 142. As shown in FIG. 11, opposed ends of the insert 162 are configured such that they generally parallel adjacent surfaces of the adapter 112. That is, in the embodiment illustrated, each end of the insert 162 has converging slanting surfaces 175 and 177 generally parallelling the slant or slope of the upper and lower surfaces 126 and 128, respectively, of the adapter 112. Notably, the slanting surfaces 175 and 177 each define a generally planar surface and converge toward each other and toward a forward or front side of the insert 162. That is, the surfaces 175 and 177 converge toward that side of the insert 162 to which the resilient member 165 is fixedly joined. Moreover, the axial distance separating the slanted surfaces 175 and 177 proximates the axial distance between the surfaces 126 and 128 along the centerline of the hole or bore 142. As such, no portion of the insert 162 projects axially outwardly beyond the slanting surfaces 126, 128 of the adapter 112 when the insert 162 is properly positioned therewithin thus allowing the cavity 152 of the tooth 114 to readily and easily pass thereover when the tooth assembly 110 is to be assembled.

Turning to FIG. 12, if the insert 162 is improperly positioned within the bore 142 of the adapter 112, the configuration of the insert 162 will quickly identify a problem involving placement of the insert 162. In a most preferred form of the invention, the configuration of the insert 162 will inhibit attachment of the tool 114 to the adapter 112 when the insert 162 is improperly positioned in the bore 142 of the adapter 112. As shown, if the insert 162 is improperly positioned within the bore 142 of the adapter 112, at least a portion of the slanted surface configurations 175 and 177 at opposite ends of the insert 162 will project beyond the limits of the hole or bore 142 thereby quickly and readily identifying a problem with placement of the insert 162 thereby alerting the person assembling the retainer pin assembly 118 that placement or orientation of the insert 162 within the hole or bore 142 and relative to the adapter 112 requires correction. Moreover, in a most preferred form of the invention, the surface configurations 175 and 177 at opposed ends of the insert are specifically designed such that when the insert 162 is improperly positioned within the support 112, they project beyond the surfaces 126 and 128 of the adapter so as to prevent the tool 114 from being slidably moved to the extent necessary to establish a cooperative relationship between the axially aligned holes 156 in the tool and the bore 142 in the adapter 112. As such, the tool 114 cannot be assembled to the support 112 until the insert 162 of the retention pin assembly 118 is properly positioned for operation.

Another embodiment of a retainer pin assembly according to the present invention is illustrated in FIGS. 13 through 16 and is designated therein by reference numeral 218. The retainer pin assembly 218 and the excavating assembly which it is arranged in combination therewith are similar, and function in a similar manner to that described above with reference to FIGS. 1 through 6. The elements of this alterative embodiment of the retainer pin assembly and the excavating assembly that are identical or functionally analogous to those of the embodiment described above are designated by reference numerals identical to those used for the earlier described embodiment with the exception that this alternative embodiment reference numerals are in the 200 series.

As shown, the retaining pin assembly 218 is used to releasably secure a tooth or other suitable ground engaging tool 214 to an adapter or support 212 in lighter duty applications where the forces acting on the retaining pin assembly are not as sever or of a magnitude where a greater holding force is required for maintaining the retaining pin in operable association with the adapter. The adapter 212 is suitably secured to and extends forwardly from a lip 215 of an excavating bucket or the like. A nose portion 222 of the adapter 212 has a pair of laterally spaced side walls 224 extending between opposed upper and lower surfaces 226 and 228, respectively. The support 212 has a bore 242 extending therethrough. Although the bore 242 is shown in a vertical disposition, and as mentioned above, the bore 242 can be disposed at any suitable orientation without detracting or departing from the spirit and scope of the present invention.

As is conventional, a rear end of the tool 214 is provided with a suitably shaped blind cavity or pocket 252 that is shaped in a fashion complementary to the forward end of the adapter or support 222. That is, the pocket 252 includes upper and lower opposed interior surfaces 253, 254 that complement the upper and lower surfaces 228, 228, respectively, on the adapter 212. Pocket 252 further defines opposed interior sidewalls 255 configured to complement the sidewalls 224 of the adapter 212. Suffice it to says pocket 252 is shaped to fit along and snugly about a lengthwise portion of the support 212. A pair of axially aligned holes or apertures 256 intersect with the pocket 252.

Figure 14:
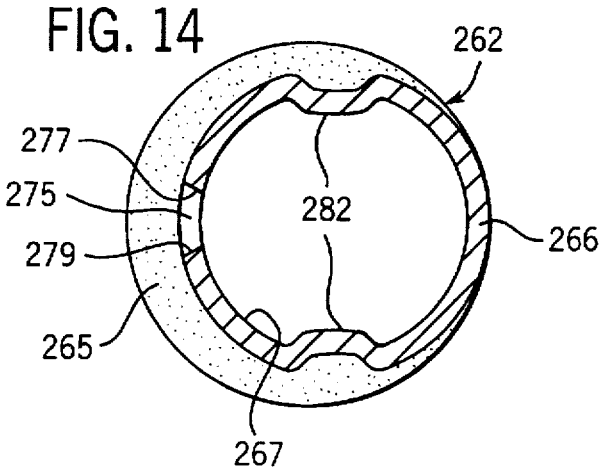
FIG. 14 is a sectional view taken along line 14—14 of FIG. 13.

The retainer pin assembly 218 is substantially similar to and operates in a substantially similar fashion to the pin assembly 18 discussed in detail above. The retainer pin assembly 218 includes an insert 262 and a retainer pin 264. As shown in FIGS. 13 through 16, the insert 262 includes a resilient member 265 attached to an exterior forward side or section of a sleeve 266 defining an elongated bore 267 opening to opposite ends of the sleeve 266. Sleeve 266 is preferably formed from an alloy steel or other suitable rigid material. Notably, and as shown in FIG. 14, sleeve 266 defines a bore 267 and a longitudinal slot 275 extending the length thereof. The sleeve 266 thus defines opposed and confronting edges 277 and 279. The sleeve 266 is designed as roll pin and has a certain circumferential spring force acting to urge the edges 277 and 279 toward each other. The resiliency of the member 265 extending across and along the slot 275 furthermore tends to urge the opposing edges 277 and 279 toward each other while allowing for expansion of the slot 275 and thereby the bore 267 of sleeve 266 when the pin 264 is installed thereinto. Notably, however, the outside diameter of the insert 262, including the sleeve 266 and resilient member 265, is slightly larger than the diameter of the bore 242 in the support 212 such that the insert 262 is a light drive-in fit into the bore 242 of the adapter 212. Additionally, the insert 262 is held axially within the bore 242 once the tool 214 is assembled thereto by cooperative engagement with the interior surfaces on the tool 214 in the area of the pocket 254.

Figure 15:
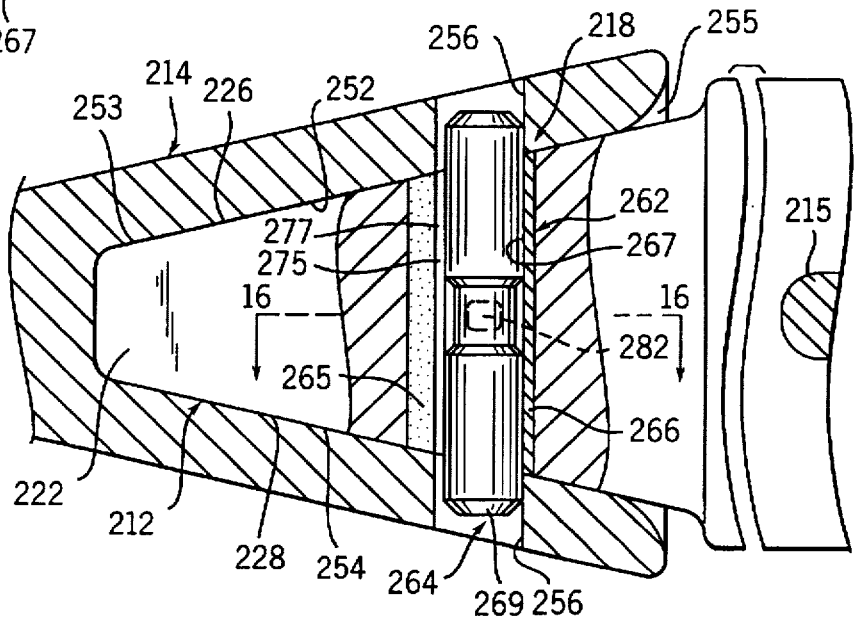
FIG. 15 is a view similar to FIG. 13 but showing the tool in assembled relation relative to the carrier.
Figure 16:
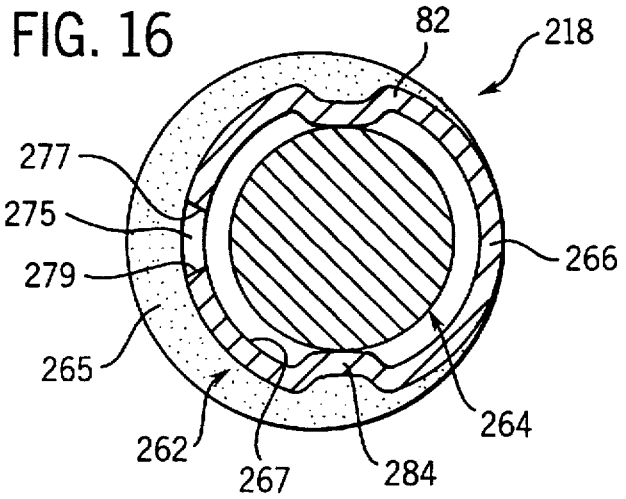
FIG. 16 is a sectional view taken along line 16—16 of FIG. 15.

As shown in FIGS. 15 and 16, a positive locking relationship is established between the retaining pin 264 and the insert 262 when the pion 262 is endwise inserted within the sleeve 266. As shown, the bore 267 defined by sleeve 266 is substantially equal in diameter to the outside diameter of the pin 264. Approximately midlength thereof, the sleeve 266 is provided with a detent 282 extending radially inwardly of the diameter of bore 267. In a most preferred from of the invention, the sleeve 266 is provided with a second detent 284 (FIG. 16) arranged in diametrically opposed relation relative to detent 282. In the illustrated form of the invention, the detents 282 and 284 are configured as indentations in the side of the sleeve 266. It will be appreciated, however, other suitable and well known forms of detents would equally suffice without detracting or departing from the spirit and scope of the present invention. Either alone or in combination, the detents 282, 284 define a passage therebetween that is significantly less than the outside diameter of the retaining pin 264.

The retaining pin 264 is substantially similar to retaining pin 64 discussed in detail above. Suffice it to say, the retaining pin 264 defines a recess or channel 276 approximately midlength thereof for radially accommodating the detents 282 and 284 on the sleeve 266.

Prior to assembly of the tooth 214 onto the support or adapter 212, the insert 262 of the retainer pin assembly 218 is installed in the bore 242 of the adapter 212. The outside diameter of the insert 262, including the sleeve 266 and resilient member 265, is preferably slightly larger than the diameter of the bore 242 in the support or adapter 212 so that the insert 262 is a light drive-in fit into the bore 42. The tight fir of the insert 262 within the bore 242 of the adapter 212 causes the resilient member 265 to urge the opposing edges 277, 279 on the sleeve 266 toward each other. In addition, the insert 262 is further held within the bore 242 once the tooth 214 is assembled thereto by cooperative engagement with the interior surfaces on the tooth 214 in the area of the pocket 254.

To assemble the tooth 214 to the adapter 212 it is only necessary to place and slide the tooth 214 over the free end of the adapter 212 such that the opposed holes 256 in the tooth 214 are generally in alignment with the bore 242 defined by the adapter 212. The retaining pin 264 is then driven into the sleeve 266 (FIGS. 15 and 16) to bias the tooth 214 rearwardly along the adapter 212, thereby maintaining a tight fit between the tooth 214 and adapter 212. Preferably, the holes 256 in the tooth 214 are intentionally offset or misaligned with the bore 242 in the adapter 212 to provide the desired biasing effect. Also, the resilient member 265 serves to bias the pin 264 in the desired rearward direction. The effect of this biasing feature is to resiliently urge the tooth 214 onto the adapter 212.

Chamfer 269 at the end of pin 264 will guide the pin 264 into the bore 267 of sleeve 266. If the sleeve 266 has retracted to reduce the diameter of bore 267, the chamfer 269 will cause an expansion of the resilient sleeve 266 radially outwardly to conform to the outside diameter of the pin 264. Moreover, the chamfer 269 facilitates the endwise passage of the pin 264 across the detents 282 and 284. As will be appreciated, when the pin 264 passes the detents the sleeve 266 will expand against the resilient member 265 allowing the pin 264 to move therepast. When the pin 264 passes about midlength of the sleeve 266 the recess or channel 276 will axially along with the detents 282 and 284 thus causing the detents 282 and 284 to automatically snap into a positive locking relationship with the pin 264 thereby securing the pin 264 against further endwise axial displacement relative to the bore 267. As will be appreciated, the pin contacting sides of the detents 282, 284, the shoulders of the pin 264 in the area of channel 276, or both can be ramped or chamfered in the manner discussed above, to facilitate passage of the pin therepast and/or control the axial direction from which the pin can be released from its positive locked relationship with the adapter 212.

Figure 18:
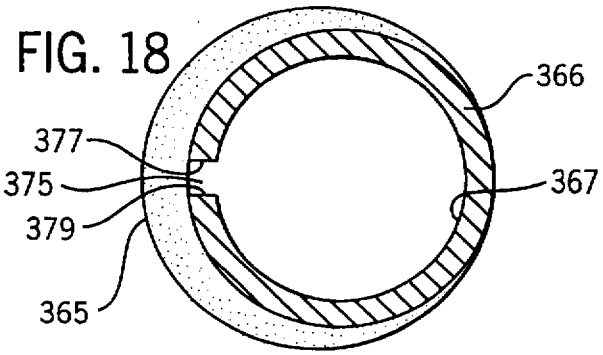
FIG. 18 is a sectional view taken along line 18—18 of FIG. 17.
Figure 19:
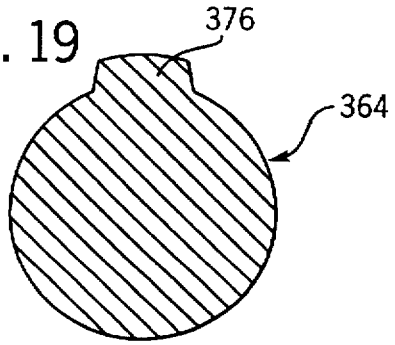
FIG. 19 is a sectional view taken along line 19—19 of FIG. 17.
Figure 17:
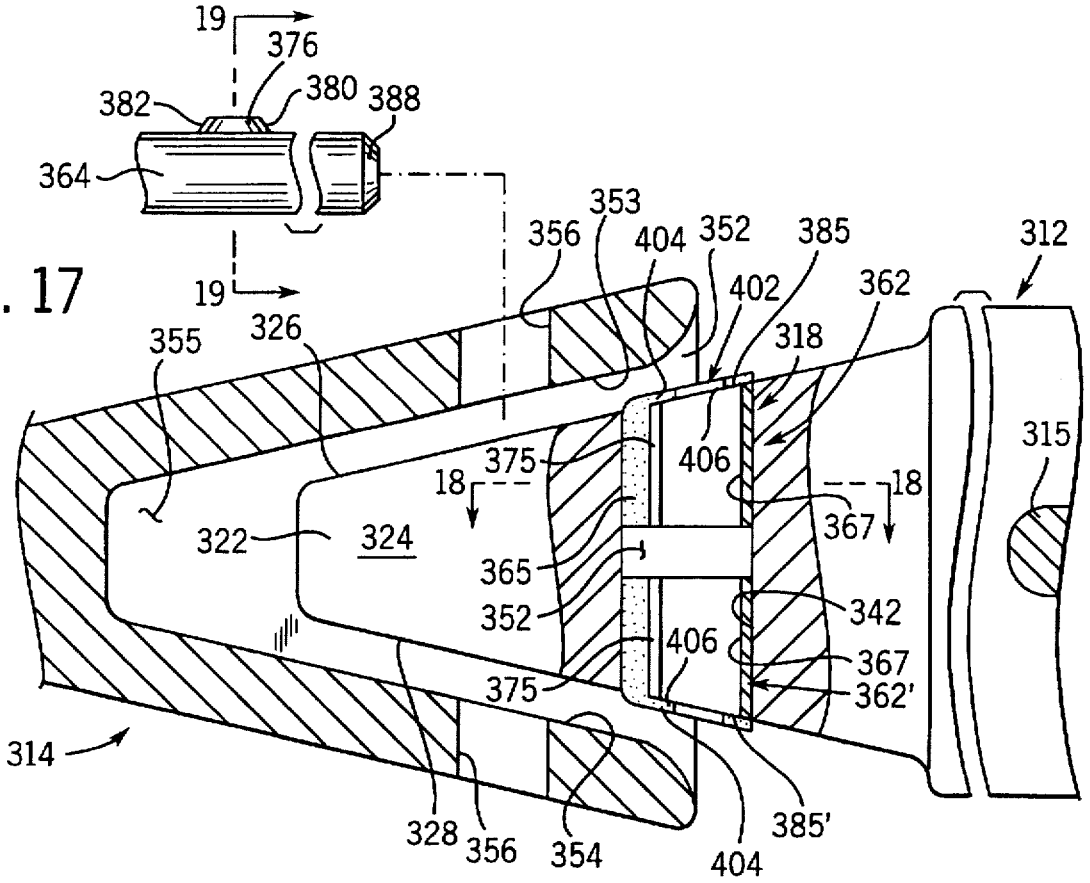
FIG. 17 is a view similar to FIG. 2 but showing still another embodiment of the present invention.

Another embodiment of a retainer pin assembly according to the present invention is illustrated in FIGS. 17 through 19 and is designated therein by reference numeral 318. The retainer pin assembly 318 and the excavating assembly which it is arranged in combination therewith are similar, and function in a similar manner to that described above with reference to FIGS. 1 through 6. The elements of this alterative embodiment of the retainer pin assembly and the excavating assembly that are identical or functionally analogous to those of the embodiment described above are designated by reference numerals identical to those used for the earlier described embodiment with the exception that this alternative embodiment reference numerals are in the 300 series.

As shown, the retaining pin assembly 318 is used to releasably secure a tooth or other suitable ground engaging tool 314 to an adapter or support 312 in lighter duty applications where the forces acting on the retaining pin assembly are not as sever or of a magnitude where a greater holding force is required for maintaining the retaining pin in operable association with the adapter. The adapter 312 is suitably secured to and extends forwardly from a lip 315 of an excavating bucket or the like. A nose portion 322 of the adapter 312 has a pair of laterally spaced side walls 324 extending between opposed upper and lower surfaces 326 and 328, respectively. The support 312 has a bore 342 extending therethrough. Although the bore 342 is shown in a vertical disposition, and as mentioned above, the bore 342 can be disposed at any suitable orientation without detracting or departing from the spirit and scope of the present invention.

As is conventional, a rear end of the tool 314 is provided with a suitably shaped blind cavity or pocket 352 that is shaped in a fashion complementary to the forward end of the adapter or support 322. That is, the pocket 352 includes upper and lower opposed interior surfaces 353, 354 that complement the upper and lower surfaces 326, 328, respectively, on the adapter 312. Pocket 352 further defines opposed interior sidewalls 355 configured to complement the sidewalls 324 of the adapter 312. Suffice it to say, pocket 352 is shaped to fit along and snugly about a lengthwise portion of the support 312. A pair of axially aligned holes or apertures 356 intersect with the pocket 352.

The retainer pin assembly 318 is substantially similar to and operates in a substantially similar fashion to the pin assembly 18 discussed in detail above. In this embodiment of the invention, the retainer pin assembly 318 includes a pair or two inserts 362 and 362' and a retainer pin 364. The inserts 362 and 362' are substantially identical to each other. In the preferred form of the invention, insert 362 is inserted into the bore 342 from one side or surface of the adapter 312 while insert 362' is inserted into the bore 342 from an opposite side or surface of the adapter 312. The cumulative length of the inserts 362 and 362' is less than the distance separating the surfaces of the adapter 312 at the location wherein the inserts 362, 362' are inserted within the bore 342. Accordingly, a gap or opening 352 is defined between adjacent ends of the sleeves 362 and 362'.

The sleeves 362 and 362' are substantially equal in length and substantially identical in construction. Accordingly, only insert 362 will be described in detail with the understanding that insert 362' is substantially identical thereto. Each insert includes a resilient member 365 attached to an exterior forward side or section of a sleeve 366. Sleeve 366 is preferably formed from an alloy steel or other suitable rigid material Notably, and as shown in FIGS. 17 and 18, the sleeve 366 of each insert defines a bore 367 opening to opposite ends of the respective sleeve and a longitudinal slot 375 extending the length thereof The sleeve 366 thus defines opposed and confronting edges 377 and 379. Each sleeve 366 is preferably designed as roll pin and has a certain circumferential spring force acting to urge the edges 377 and 379 toward each other. The resiliency of the member 365 extending across and along the slot 375 furthermore tends to urge the opposing edges 377 and 379 toward each other while allowing for expansion of the slot 375 and thereby the bore 367 of sleeve 366 when the pin 364 is installed thereinto. Notably, however, the outside diameter of the insert 362, including the sleeve 366 and resilient member 365, is slightly larger than the diameter of the bore 342 in the support 312 such that the insert 362 is a light drive-in fit into the bore 342 of the adapter 312. Additionally, the insert 362 is held axially within the bore 342 once the tool 314 is assembled thereto by cooperative engagement with the interior surfaces on the tool 314 in the area of the pocket 354.

To facilitate proper placement of each insert 362, 362' within the bore 342 of the adapter 312, each insert 362, 362' is preferably provided with a visual indication of proper placement of the insert within the bore 342. In this regard, each insert 362 and 362' has a slanted surface 385 and 385' defined at one end thereof. The slanted surface 385, 385' is configured such that they parallel the adjacent surface of the adapter or support 312 when the insert is properly positioned within the bore 342. As will be appreciated, if either insert 362, 362' is improperly positioned within the bore 342, the slanted surface configuration of the misplaced insert 362, 362' would provide a visual indication of misplacement and could prevent the tool 314 from being moved into proper position relative to the adapter or support 312.

The retainer pin 364 is similar to retaining pin 64 discussed in detail above. Rather than having a recess or channel formed along the length thereof, however, the retaining pin 364 shown in FIGS. 17 and 19 includes a detent 376 projecting radially outwardly relative the outside diameter of the pin 364. The detent 376 is arranged approximately midlength of the pin 364. In a preferred form of the invention, the detent 376 defines chamfered or ramped shoulders 380 and 382 thereon for facilitating insertion of the pin 364 within and through the inserts 362 and 362'. Moreover, opposed ends of the retaining pin are likewise preferably provided with chamfers or ramped surfaces 388 for facilitating insertion of the pin 364 from either direction. As mentioned above, the annular shoulders 380, 382 on the pin 364 can be designed to control the direction of insertion and removal of the pin 364 relative to the inserts 362, 362'.

Prior to assembly of the tooth 314 onto the support or adapter 312, the inserts 362 and 362' of the retainer pin assembly 318 are installed within and preferably from opposite ends of the bore 342 of the adapter 312. The outside diameter of the inserts 362, 362', including the sleeve 366 and resilient member 365, of each insert 362, 362' is preferably slightly larger than the diameter of the bore 342 in the support or adapter 312 so that each insert 362, 362' maintains a light drive-in fit into the bore 342. The tight fit of the inserts 362, 362' within the bore 342 of the adapter 312 causes the resilient member 365 to urge the opposing edges 377, 379 on each sleeve 366 toward each other. In addition, each insert 362 is further held within the bore 342 once the tooth 314 is assembled thereto by cooperative engagement with the interior surfaces on the tooth 314 in the area of the pocket 354. As explained above, the slanted surfaces 385 and 385' on the inserts 362 and 362', respectively, provide a visual reference regarding proper placement of the inserts 362, 362' within the bore 342 of the adapter or support 312.

To assemble the tooth 314 to the adapter 312 it is only necessary to place and slide the tooth 314 over the free end of the adapter 312 such that the opposed holes 356 in the tooth 314 are generally in alignment with the bore 342 defined by the adapter 312. The retaining pin 364 is then driven into the inserts 362, 362' to bias the tooth 314 rearwardly along the adapter 312, thereby maintaining a tight fit between the tooth 314 and adapter 312. Preferably, the holes 356 in the tooth 314 are intentionally offset or misaligned with the bore 342 in the adapter 312 to provide the desired biasing effect. Also, the resilient member 365 on each insert 362, 362' serves to bias the pin 364 in the desired rearward direction. The effect of this biasing feature is to resiliently urge the tooth 314 onto the adapter 312.

Chamfer 388 at the end of pin 364 will guide the pin 364 into the bore 367 of sleeve 366 of insert 362. If the sleeve 366 has retracted to reduce the diameter of bore 367, the chamfer 389 will cause an expansion of the resilient sleeve 366 radially outwardly to conform to the outside of the pin 364. Moreover, the chamfers 380, 382 facilitate the endwise passage of the detent 376 past the edge of the sleeve 366. As will be appreciated, when the pin 364 passes axially along, the sleeve 366 will expand against the resilient member 365. When the pin 364 passes about midlength thereof, the detent 376 on the pin 364 will pass from the sleeve 366 into and be captured within the opening or recess 352 between the inserts 362 and 362'. Of course, when the detent 376 passes from the sleeve 366 the insert 362 will automatically contract about the outside surface of the pin 364 thereby securing the pin 364 against further endwise axial displacement relative to the adapter 312. As will be appreciated, one or both of the shoulders of the detent 376 can be ramped or chamfered in the manner discussed above, to facilitate passage of the pin therepast and/or control the axial direction from which the pin can be released from its positive locked relationship with the adapter 212.

The pin retainer assembly of the present invention may further include a seal 402 for inhibiting dirt and debris from interfering with the locking relationship of the retainer pin and the carrier. In the illustrated embodiment, seal 402 includes a planar member 404 disposed at the free end of the insert of the retainer pin insert (FIG. 17). The planar member 404 is formed from an elastomeric material. In the illustrated form of the invention, the planar member 404 is formed integral with the resilient member of the insert. It should be appreciated, however, that it is well within the spirit and scope of the present invention to provide the planar member 404 as a separate piece from the insert. Moreover, the planar member 404,defines a central bore 406 that allows passage of the retainer pin therethrough. As will be appreciated, the bore 406 is sized to fir snugly about the retainer pin when the pin is passed endwise therethrough. In the illustrated form of the invention, a planar member 404 is disposed at opposite ends of the insert. To allow debris inadvertently passing between the retainer pin and the insert to pass therethrough, it may be desirable to position the planar member at only one end of the insert of the retainer pin assembly.

In working conditions, when a tool is to be repaired or replaced, a punch is used to drive the retaining pin out of engagement with the insert. To facilitate disengagement of the pin 18 from the positive lock, when the pin is driven in an axial direction, the ramps on either the pin, the locking member or both facilitate release of the pin from its locked relationship. Preferably, the pin also has both ends beveled such that the it is reversible in operation. Alternatively, the pin or locking member can be configured to control the direction of insertion and release for the locking pin. Once the retaining pin is removed, the tool is removed and a replacement tool is installed. The tool is thereafter readily maintained in place by reinserting the pin into locked relationship relative to the carrier or adapter. Since the pin does not have to be oriented in any specific manner for insertion, the chances for improper tooth installation is minimized.

With the present invention, a relatively small, centralized and generally localized area along the length of the locking pin is used to maintaining the locking pin in positive locked relationship relative to the carrier regardless of the level of extreme loads or the bending of the pin. That is, the centrally disposed locking engagement between the retaining pin and the implement or apparatus maintains the pin within the implement or apparatus even though the pin may bend as a result of the extreme digging forces applied to the tool during operation of the excavating equipment. As will be appreciated, the ability of the present invention to positively secure the pin against endwise movement approximately midlength significant reduces and substantially eliminates the effect bending forces have on the pin since the pin is positively locked in place at a location where the bending forces acting on the pin are at their least. Moreover, the provision of an elastomer in combination with the sleeve provide a dual benefit. First, the elastomer maintains the tool in snug engagement with the carrier thereof. Also, the elastomer augments the positive locking engagement of the lock with the adapter when the pin bends in response to extreme loading conditions being applied to the tool. That is, when the pin bends in response to extreme loading conditions being applied to the tool and thus to the pin, the bending pin displaces the elastomer thus enhancing the force acting to maintain the lock in positive engagement with the retaining pin.

Positioning the lock for the pin at about midlength of the pin inhibits dirt, dust and debris from interfering with operation of the locking mechanism. The present invention is advantageously designed such that the rubber or elastomer fitted about the pin assembly is protected to the fullest extent by the tool after the tool is assembled onto the receiving implement. In a preferred form, the seal at the end of the insert helps to maintain dust, dirt and debris from interfering with proper operation of the lock.

Still another advantageous feature of the present invention involves the ability to provide a pin retainer wherein the pin is always inserted correctly into the receiving bore on the receiving implement. Moreover, the combination of the resilient member and the rigid sleeve provide a self-aligning insert that facilitates assembly and disassembly of the retaining pin and securely biases the tool onto the receiving implement.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. An excavator tooth assembly comprising:

an adapter adapted for securement to an edge of excavating equipment and defining a bore extending therethrough;

an excavation tooth having a cutting end and a hollow mounting end slidably mounted about and along a lengthwise portion of said adapter, said mounting end having two axially aligned holes to act in conjunction with the bore extending through the adapter; and a retaining pin assembly for releasably securing said excavation tooth and said adapter in operable relation relative to each other, said retaining pin assembly including a rigid elongated sleeve sized to snugly fit within the bore defining by said adapter, an elongated retaining pin slidably fitted within said sleeve such that opposite ends of said pin extend at least partially through and operably engage said tooth thereby releasably holding said tooth and adapter in operable relation relative to each other, and a locking mechanism for operably securing said pin in positive interlocking relationship with said adapter and to restrain inadvertent axial displacement of the retaining pin during operation of said tooth assembly.

2. The tooth assembly of claim 1 wherein said locking mechanism includes a locking member extending radially inwardly from said sleeve into interlocking engagement with said retaining pin.

3. The tooth assembly of claim 2 wherein said locking mechanism further includes a spring for resiliently biasing said locking member into engagement with said retaining pin.

4. The tooth assembly of claim 3 wherein said spring comprises a resilient member attached to an outer surface of said sleeve.

5. The assembly of claim 4 wherein said resilient member is attached to an exterior forward section of said sleeve and said locking member is embedded in said resilient member and extends through an aperture in said sleeve.

6. The assembly of claim 2 wherein said retaining pin has a recess formed in a center section for radially accommodating said locking member and thereby establishing a releasable locking relationship with said insert.

7. The assembly of claim 6 wherein said recess is configured to facilitate disengagement of the locking member from the retaining pin when the retaining pin is driven in an axial direction.

8. The tooth assembly of claim 1 further comprising a biasing member positioned between a forward section of the retaining pin and a peripheral surface defined by the bore in said adapter for biasing said retaining pin and thereby said excavation tooth rearwardly along said adapter.

9. The tooth assembly according to claim 1 wherein said sleeve is configured to visually indicate proper insertion of the sleeve within the bore of the adapter.

10. The tooth assembly according to claim 1 wherein said sleeve is split longitudinally and includes a detent along the length thereof, and wherein said retaining pin has a recess along the length thereof for accommodating the detent therewithin.

11. The tooth assembly according to claim 1 wherein the bore defining by said adapter is larger than the either of the two axially aligned holes defining by said excavation tooth.

12. The tooth assembly according to claim 1 wherein said retaining pin has a generally cylindrical-like configuration between opposed ends thereof.

13. The tooth assembly according to claim 12 wherein said retaining pin is provided with chamfered ends to facilitate insertion of said pin into said sleeve.

14. The tooth assembly according to claim 1 wherein said retaining pin is of unitary construction thereby adding strength and rigidity thereto.

15. The tooth assembly according to claim 1 further including seals disposed at opposed ends of said retaining pin assembly for inhibiting dirt, dust and debris from interfering with proper operation of the retaining pin assembly.

16. An excavator tooth assembly comprising:

an adapter having opposed surfaces and a bore opening to said surfaces and extending through said adapter;

an excavation tooth having a cutting end and a hollow mounting end slidably mounted along and about a portion of said adapter, said mounting end having two axially aligned holes that act in conjunction with the bore extending through the adapter; and an insert configured for insertion in the bore of the adapter between said opposed surfaces, said insert including elastomeric material attached to and along an exterior surface of a rigid elongated sleeve, said insert being operably maintained within said bore by cooperative engagement with said excavation tooth; and a retaining pin extending endwise through said sleeve such that opposed ends of said pin extend at least partially through the aligned holes and operably engage surfaces on said tooth thereby operably securing said excavation tooth and said adapter in operable relation relative to each other, with said retaining pin being secured within the insert by a releasable lock to restrain axial movement of said retaining pin during operation of the tooth assembly.

17. The tooth assembly of claim 16 wherein the elastomeric material surrounds a circumferential portion of the sleeve.

18. The tooth assembly of claim 17 wherein the elastomeric material surrounds about a 270 degree circumferential portion of the sleeve.

19. The tooth assembly of claim 16 wherein said releasable lock comprises a locking member extending radially inwardly from the insert for interlocking engagement with said retaining pin.

20. The assembly of claim 19 wherein said locking member is resiliently urged toward a centerline of and extends through an aperture in said sleeve.

21. The assembly of claim 20 wherein said retaining pin is configured toward a center section thereof for locking engagement with said locking member.

22. The tooth assembly of claim 21 wherein said retaining pin has a generally cylindrical-like configuration between opposed ends thereof with a centrally disposed recess having sloping shoulders to facilitate disengagement of the lock when the retaining pin is purposefully driven in an axial direction.

23. The tooth assembly according to claim 22 wherein said retaining pin is provided with chamfered ends to facilitate insertion of said pin into said sleeve.

24. The tooth assembly according to claim 16 wherein said sleeve is configured to visually indicate proper insertion of the sleeve within the bore of the implement.

25. The tooth assembly according to claim 16 wherein said sleeve is split longitudinally and includes a detent along the length thereof, and wherein said retaining pin has a recess along the length thereof for accommodating the detent therewithin.

26. The tooth assembly according to claim 16 wherein the bore defined by said adapter is larger than the either of the two axially aligned holes defined by said excavation tooth.

27. The tooth assembly according to claim 16 wherein said retaining pin is of unitary construction thereby adding strength and rigidity thereto.

28. The tooth assembly according to claim 16 further including seals disposed at opposed ends of said retaining pin assembly for inhibiting dirt, dust and debris from interfering with proper operation of the retaining pin assembly.

29. The tooth assembly according to claim 28 wherein said seals are integrally formed from said elastomeric material.

30. An excavator tooth assembly comprising:

an adapter having opposed surfaces and defining a bore extending therethrough and opening to said opposed surfaces;

an excavation tooth having a cutting end and a hollow mounting end slidably mounted about and along a lengthwise portion of said adapter, said mounting end having two axially aligned holes in the hollow mounting end of the tooth that act in conjunction with the bore extending through the adapter;

an insert held within the bore defining by said adapter and between said opposed surfaces by cooperative engagement with said excavation tooth, said insert having elastomeric material attached to an exterior surface of a rigid sleeve, and a locking member biased radially inwardly under the influence of said elastomeric material and through an aperture in said sleeve; and a retaining pin extending endwise through said sleeve such that opposed ends of said pin extend at least partially through the axially aligned holes and engage surfaces in the tooth thereby securing said excavation tooth and said adapter in operable relation relative to each other, with said locking member engaging a central portion of said retaining pin to restrain axial displacement of the retaining pin during operation of the tooth assembly.

31. The tooth assembly of claim 30 wherein the sleeve has a cylindrical-like configuration between opposed ends thereof.

32. The tooth assembly of claim 31 wherein the elastomeric material surrounds a circumferential portion of the sleeve.

33. The tooth assembly of claim 31 wherein the elastomeric material surrounds about a 270 degree circumferential portion of the sleeve.

34. The tooth assembly of claim 30 wherein said retaining pin has a channel formed in a center section thereof for locking engagement with said locking member.

35. The tooth assembly of claim 34 wherein said retaining pin is configured with at least one sloped shoulder leading to said channel to facilitate and control disengagement of the locking member from the retaining pin.

36. The tooth assembly according to claim 30 wherein said insert is configured to visually indicate proper insertion of the insert within the bore of the implement.

37. The tooth assembly according to claim 30 wherein said sleeve is split longitudinally and includes a detent along the length thereof, and wherein said retaining pin has a recess along the length thereof for accommodating the detent therewithin.

38. The tooth assembly according to claim 30 wherein the bore defined by said adapter is larger than the either of the two axially aligned holes defined by said excavation tooth.

39. The tooth assembly according to claim 30 wherein said retaining pin has a generally cylindrical-like configuration between opposed ends thereof.

40. The tooth assembly according to claim 39 wherein said retaining pin is provided with chamfered ends to facilitate insertion of said pin into said insert.

41. The tooth assembly according to claim 30 wherein said retaining pin is of unitary construction thereby adding strength and rigidity thereto.

42. The tooth assembly according to claim 36 further including seals disposed at opposed ends of said retaining pin assembly for inhibiting dirt, dust and debris from interfering with proper operation of the retaining pin assembly.

43. An excavator tooth assembly comprising:

an adapter having a mounting end portion and a nose piece end portion, the nose piece end portion having a forwardly extending tapered configuration with a bore extending vertically therethrough;

an excavation tooth having a cutting end and a hollow mounting end slidably mounted to the nose piece portion of said adapter, the mounting end of said tooth having two opposed and aligned holes extending vertically therethrough to act in conjunction with the bore in the nose piece portion of the adapter;

an insert held within the bore defined by said adapter through cooperative engagement with said excavation tooth, said insert having elastomeric material attached to and along an exterior portion of a rigid sleeve, and a locking member biased radially inwardly under the influence of said elastomeric material and through an aperture in said sleeve; and an elongated retaining pin extending endwise through said sleeve and with opposed ends of said pin extending at least partially through the opposed holes defining by said tooth thereby securing said excavation tooth and said adapter in operable combination relative to each other, said retaining pin having a recess formed toward a center section thereof for locking engagement with said locking member thereby restraining inadvertent axial displacement of the retaining pin during operation of the tooth assembly.

44. A retainer pin assembly for releasably holding an apertured ground engaging tool in position relative to an apertured implement, said retainer pin assembly including an elongated rigid metal sleeve having a first length sized relative to a bore in said apertured implement; an elongated retaining pin slidably received within said sleeve and having a second length greater than said first length such that a lengthwise portion of said pin is received between opposed ends of said sleeve while opposed ends of said sleeve extend axially beyond said sleeve and operably engage said tool; and a releasable lock mechanism for restraining inadvertent axial displacement of said retaining pin relative to said sleeve.

45. The retainer pin assembly according to claim 44 wherein said ground engaging tool is an excavating tooth.

46. The retainer pin assembly according to claim 44 further including elastomeric material attached to and along an exterior surface of said sleeve.

47. The retainer pin assembly according to claim 46 wherein said elastomeric material is adapted to bias a locking member of said lock mechanism into engagement with said retaining pin.

48. The retainer pin assembly according to claim 44 wherein said sleeve is split longitudinally and includes a detent along the length thereof forming part of said lock mechanism, and wherein said retaining pin has a recess for releasably accommodating the detent therewithin.

49. The retainer pin assembly according to claim 44 wherein said sleeve is configured to visually indicate proper insertion within the bore of said apertured implement.

50. The retainer pin assembly according to claim 44 wherein said sleeve is configured to inhibit attachment of the tool to the implement when the sleeve is incorrectly positioned within the bore of the apertured implement.

51. The retainer pin assembly according to claim 44 further including a sealing apparatus for inhibiting dirt, dust and debris from interfering with proper operation of the retainer pin assembly.

52. The retainer pin assembly according to claim 44 wherein said retaining pin has a generally cylindrical-like configuration between opposed ends thereof.

53. The retainer pin assembly according to claim 44 wherein said retaining pin is of unitary construction to add strength and rigidity to the retainer pin assembly.

54. The retainer pin assembly according to claim 44 further including seals disposed at opposed ends of retaining pin assembly for preventing dirt, dust and debris from interfering with proper operation of the retainer pin assembly.

55. A retainer pin assembly for releasably holding an apertured ground engaging tool in operative combination with an elongated and apertured carrier having a mounting end portion, said retainer pin assembly including a rigid metal cylindrically shaped sleeve; an elongated retaining pin slidably received within said sleeve and sized such that opposed ends of said pin axially project beyond the sleeve to operably engage with surfaces defined on said apertured tooth; elastomeric material affixed to an exterior portion of and along said sleeve for resiliently urging the retaining pin and thereby the tooth engaged thereby in a direction toward the mounting end of said carrier: and a lock for restraining said retaining pin against endwise movement relative to said sleeve.

56. The retainer pin assembly according to claim 55 wherein said ground engaging tool is an excavating tooth.

57. The retainer pin assembly according to claim 56 wherein said carrier is an adapter extending endwise from an excavating implement.

58. The retainer pin assembly according to claim 55 wherein said sleeve comprises a pair of inserts adapted to be endwise received within said apertured carrier, each insert having an elongated split configuration, with confronting ends of said inserts being axially spaced from each other.

59. The retainer pin assembly according to claim 58 wherein said insert is split longitudinally and includes a detent forming part of said lock along the length thereof, and wherein said retaining pin has a recess for accommodating the detent therewithin.

60. The retaining pin assembly according to claim 58 wherein said retaining pin has a generally cylindrical exterior configuration with a detent radially extending outwardly from the exterior, said detent serving as part of said lock and is received between the confronting ends of said inserts to releasably secure the retaining pin relative to said sleeve.

61. The retainer pin assembly according to claim 55 wherein said sleeve is configured to visually indicate proper insertion within said apertured carrier.

62. The retainer pin assembly according to claim 33 wherein said sleeve is configured to inhibit attachment of the tool to the carrier when the sleeve is improperly installed within the apertured carrier.

63. The retainer pin assembly according to claim 55 further including a sealing apparatus form inhibiting dirt, dust and debris from interfering with proper operation of the retainer pin assembly.

64. The retainer pin assembly according to claim 55 wherein said retaining pin has a generally cylindrical-like configuration between opposed ends thereon.

65. The retainer pin assembly according to claim 64 wherein said retaining pin is provided with chamfers at opposite ends to facilitate insertion of the retaining pin into said sleeve.

66. The retainer pin assembly according to claim 55 wherein said retaining pin is of unitary construction.

* * * * *